US006190573B1

(12) United States Patent
Ito

(10) Patent No.: US 6,190,573 B1
(45) Date of Patent: Feb. 20, 2001

(54) EXTRUSION-MOLDED MAGNETIC BODY COMPRISING SAMARIUM-IRON-NITROGEN SYSTEM MAGNETIC PARTICLES

(75) Inventor: Noboru Ito, Tokyo (JP)

(73) Assignee: Magx Co., Ltd., Tokyo (JP)

( * ) Notice: Under 35 U.S.C. 154(b), the term of this patent shall be extended for 0 days.

(21) Appl. No.: 09/258,270

(22) Filed: Feb. 26, 1999

(30) Foreign Application Priority Data

Jun. 15, 1998 (JP) ..... 10-183379
Dec. 8, 1998 (JP) ..... 10-348463

(51) Int. Cl.[7] ..... H01R 1/00
(52) U.S. Cl. ..... 252/62.55; 252/62.53; 252/62.54; 264/429
(58) Field of Search ..... 252/62.55, 62.54, 252/62.53; 264/429

(56) References Cited

U.S. PATENT DOCUMENTS 6,001,272 * 12/1999 Ikuma et al. ..... 252/62.55

FOREIGN PATENT DOCUMENTS 5-299221 * 11/1993 (JP) .

WO97/35331 * 9/1997 (WO) .

* cited by examiner

*Primary Examiner*—G. Melissa Koslow
(74) *Attorney, Agent, or Firm*—Wenderoth, Lind & Ponack, L.L.P.

(57) ABSTRACT

This invention is directed to an extrusion-molded magnet comprising a samarium-iron-nitrogen material, which is novel and capable of exhibiting excellent magnetic properties, i.e., samarium-iron-nitrogen system magnetic particles excellent in magnetic properties.

A permanent magnet material comprising a samarium-iron-nitrogen system magnetized anisotropy particles and having increased inter-iron atom distance and elevated magnetic saturation. The magnet material is prepared by a method of causing nitrogen intrusion into the iron crystal lattice of a samarium-iron alloy by holding the alloy in a nitrogen gas at about 500 degrees C. The prepared permanent magnet material is added to a thermoplastic polyolefin system synthetic resin, and the admixture is thermally fused and kneaded. The paste thus obtained is charged into an extrusion molder and extruded through a magnetic field device, which is at an end of the extrusion molder and has an internal die, thus obtaining a molded magnet. The resulting molded magnet which has a particle array in a fixed orientation and is flexible. The molded magnet is magnetized with a magnetizing device in conformity to the particle array.

14 Claims, No Drawings

EXTRUSION-MOLDED MAGNETIC BODY COMPRISING SAMARIUM-IRON-NITROGEN SYSTEM MAGNETIC PARTICLES

BACKGROUND OF THE INVENTION

1. Field of the Invention

This invention relates to magnet bodies using novel samarium-iron-nitrogen system permanent magnetic materials excellent in magnetic properties such as the magnetic flux density (Br), the coercive force (Hc) and the maximum energy product ((BH)max) and, more particularly, to extrusion-molded magnetic bodies using samarium-iron-nitrogen system magnetic particles, that is, bond magnets or synthetic-resin-molded magnets which are obtained by using the novel permanent magnet materials and excellent in moldability and flexibility.

2. Description of the Related Art

Suitable permanent magnet materials to be used have stable properties, with the magnetic flux density (Br), the coercive force (Hc) and the maximum energy product ((BH) max) being high. Extensively used magnets using these permanent magnet materials are ferrite magnets, which use barium-ferrite ($BaO6Fe_2O_3$) or strontium-ferrite ($SrO6Fe_2O_3$), and rare earth system magnets, which use samarium-cobalt ($Sm_2Co_{17}$) and neodymium-iron-boron ($Nd_2Fe_{14}B$)

Ferrite magnets are inexpensive and ready to manufacture, and are thus finding extensive applications irrespective of whether they are sintered magnets or bond magnets. Neodymium-iron-boron surpasses ferrite magnets and also surpasses samarium-cobalt magnets in magnetic properties. This material, however, is more readily oxidized than samarium-cobalt magnets, and therefore it requires precautions for preventing the oxidation. The samarium-cobalt magnets greatly surpass ferrite magnets in magnetic properties, so that they have long been used. Further researche and development to improve their property have been made, resulting in improvements in their magnetic properties.

The samarium-cobalt magnet, however, has a drawback in that cobalt is an expensive metal. For obtaining an inexpensive magnet, therefore, a permanent magnet material has been desired, which does not require cobalt and has excellent magnetic properties. Recently, a samarium-iron-nitrogen material having excellent magnetic properties comparable to the neodymium-iron-boron magnet, has been obtained in such a method that nitrogen is introduced into the iron crystal lattice of a samarium-iron alloy by holding the alloy in a nitrogen gas at about 500 degrees C. This samarium-iron-nitrogen system material, however, has a drawback in that nitrogen gets out of the iron crystal lattice when its temperature is elevated, so that it could be used for sintered magnets.

SUMMARY OF THE INVENTION

An object of the present invention is to obtain a synthetic-resin-molded magnet having excellent magnetic properties by using a samarium-iron-nitrogen material, which is novel and can exhibit excellent magnetic properties.

DESCRIPTION OF THE PREFERRED EMBODIMENTS

In a first embodiment of the present invention, a samarium-iron-nitrogen system permanent magnet material in the form of magnetic anisotropy particles and having increased inter-iron atom distance and elevated magnetic saturation is used, which is prepared by a method of causing nitrogen to be introduced into the iron crystal lattice of a samarium-iron alloy by holding the alloy in a nitrogen gas at about 500 degrees C. The magnetic anisotropy particles are added to a synthetic rubber or a thermoplastic synthetic resin.

Of the synthetic rubber and the thermoplastic synthetic resin, to which magnetic anisotropy particles are added, the synthetic rubber may be SBR (styrene-butadiene rubber), NBR (nitrile rubber), butadiene rubber, silicon rubber, butyl rubber, urethane rubber, fluorine rubber, etc., and the thermoplastic synthetic resin may be polyolefin system resin, e.g., polyethylene, polypropylene, polybutene, polyethylene chloride, polystyrene, etc., vinyl resin, e.g., vinyl chloride, polyvinyl acetate, etc., styrene system resin, as well as polyester, nylon, polyurethane, ethylene acetate-vinyl copolymer (EVA) and EVA-vinyl chloride graft copolymer. Among the compounds, thermoplastic resins, which can readily contain inorganic materials such as magnetic particles, are polyethylene chloride, EVA, NBR, polyolefin system resin and synthetic rubber, which may be used alone or in the form of their suitable mixture. In this embodiment, the polyolefin system resin is used. The magnetic anisotropy particles noted above are added to the polyolefin system resin, the mixture is kneaded, and paste thus prepared by thermal fusing is charged into an extrusion molder.

The charged paste is extruded through a magnetic field device, which is provided at an end of the extrusion molder, thus obtaining a molded magnet, which has a particle array in a fixed orientation and is flexible. The molded magnet is appropriately magnetized with a magnetizing device in conformity to the particle array. It is possible to form molded magnets having various shapes continuously by setting various die shapes. This molding method is thus suitable particularly for obtaining elongate magnets.

As for the proportions of the magnetic anisotropy particles and the thermoplastic polyolefin system synthetic resin, by increasing the synthetic resin proportion, the molding can be facilitated, while reducing the magnetic anisotropy particle proportion results in deterioration of the magnetic properties of the magnet. By increasing the magnetic anisotropy particle proportion, the magnetic properties can be improved, while reducing the proportion of the synthetic resin serving as binder results in less ready molding. As a compromise, the samarium-iron-nitrogen magnetic anisotropy particles are introduced at about 90% or more by weight.

With an extruded-molding magnet obtained by this method of using samarium-iron-nitrogen magnetic anisotropy particles according to the invention, a very high maximum energy product ((BH)max) of about 7 to 10 (MG Oe) could be obtained. This extrusion-molded magnet is thought to be very excellent in that the (BH)max of the injection-molded ferrite magnet is 1.6 to 2.3 and that of the injection-molded neodymium-iron-boron magnet is 5 to 7 and also in view of the fact that the maximum energy product generally increases in the order of the extrusion molding, the injection molding and the press molding.

In a second embodiment of the present invention, ferrite particles as magnetic anisotropy particles of such an oxidized compound as barium-ferrite ($BaO6Fe_2O_3$) or strontium-ferrite ($SrO6Fe_2O_3$) mainly composed of iron, are added in a suitable quantity to the above samarium-iron-nitrogen system permanent magnet material in the form of magnetic anisotropy particles, and this mixture is then added to and kneaded together with a thermoplastic polyolefin system synthetic resin (or a synthetic rubber or any other thermoplastic resin). This admixture is then thermally fused and charged as kneaded compound into an extrusion molder. The charged kneaded compound is extruded through a magnetic field device, which is provided at an end of the extrusion molder and has an internal die, thus obtaining a molded magnet. The molded magnet is then magnetized with a magnetizing device in conformity to its particle array, thus completing a permanent magnet.

The proportions of the samarium-iron-nitrogen system magnetic anisotropy particles and the ferrite particles may be set variously to obtain desired values of the maximum energy product ((BH)max) ranging from 2 to 7 (or 10) (MG Oe); for instance, a permanent magnet having a maximum energy product ((BH)max) of about 5 (MG Oe) can be obtained by setting the proportions of the samarium-iron-nitrogen magnetic anisotropy particles and the ferrite particles to 80 and 20%, respectively.

In the embodiments described above, magnetic anisotropy particles were used as the samarium-iron-nitrogen permanent magnet material, but it is possible to use magnetic isotropy particles as well. It is also possible to use magnetic isotropy ferrite particles as well as magnetic anisotropy ones. Thus, it is possible to conceive four different combination types of samarium-iron-nitrogen system particles and ferrite particles in dependence on whether the particles are anisotropic or isotropic, i.e., a combination type in which both the former and latter particles are magnetic anisotropy particles as in the above embodiments, one in which the former and latter particles are magnetically anisotropic and isotropic, respectively, one in which the former and latter particles are magnetically isotropic and anisotropic, respectively, and one in which both the former and latter particles are magnetically isotropic. In addition, it is possible to set the magnetic field orientation provided through the die-accommodating magnetic field device except for the combination type, in which both the former and latter particles are magnetically isotropic.

As has been described in the foregoing, according to the invention an extrusion-molded magnet using samarium-iron-nitrogen magnetic particles, can be obtained by magnetizing a magnet body, which has been obtained by adding samarium-iron-nitrogen system magnetic particles composed of samarium, iron and nitrogen to a synthetic rubber or a thermoplastic synthetic resin and extrusion molding the resultant mixture and is flexible. It is thus possible to obtain an extrusion-molded magnet, which is excellent in moldability, flexibility and magnetic properties and has a high maximum energy product ((BH)max).

In addition, according to the invention an extrusion-molded magnet which is excellent in moldability and flexibility, can be obtained by adding samarium-iron-nitrogen magnetic particles as magnetic anisotropy particles to a synthetic rubber or a thermoplastic synthetic resin and extrusion molding the resultant mixture while causing magnetic field orientation thereof. It is thus possible to obtain an extrusion-molded magnet, which is excellent in moldability and flexibility, has a magnetic particle array in a fixed orientation as well as being excellent in magnetic properties and having a high maximum energy product ((BH)max) heretofore unseen with conventional magnet materials.

And according to the invention an extrusion-molded magnet can be obtained by adding samarium-iron-nitrogen system magnetic particles as magnetic anisotropy particles to a synthetic rubber or a thermoplastic synthetic resin and extrusion molding the resultant mixture while causing magnetic field orientation thereof. It is thus possible to obtain an extrusion-molded magnet, which is excellent in moldability and flexibility, has arrays of the particles in fixed orientations as well as being excellent in magnetic properties and has a maximum energy product ((BH)max), which has heretofore been unseen with conventional magnetic materials.

Furthermore, according to the invention an extrusion-molded magnet can be obtained by adding samarium-iron-nitrogen system magnetic particles and ferrite particles as magnetic anisotropy particles to a synthetic rubber or a thermoplastic synthetic resin and extrusion molding the resultant mixture while causing magnetic field orientation thereof. It is thus possible to obtain an extrusion-molded magnet, which is excellent in moldability and flexibility, has arrays of both particles in fixed orientations and has a maximum energy product ((BH)max), which has heretofore been unseen with conventional magnetic materials. Further, the maximum energy product ((BH)max) can be set to a desired value by appropriately setting the proportion of the ferrite particles.

Moreover, by using a thermoplastic polyolefin system synthetic resin as the thermoplastic synthetic resin, it is possible to obtain a satisfactory mixing of the inorganic magnetic particles and the synthetic resin and thus obtain a satisfactory extrusion-molded magnet.

What is claimed is:

1. An extrusion-molded magnet comprising (a) samarium-iron-nitrogen system magnetic particles comprising samarium, iron and nitrogen particles, (b) ferrite particles and (c) a synthetic rubber or a thermoplastic synthetic resin.

2. The extrusion-molded magnet according to claim 1, wherein the samarium-iron-nitrogen magnetic particles are magnetic anisotropy particles.

3. The extrusion-molded magnet according to claim 1, wherein the samarium-iron-nitrogen system magnetic particles and ferrite particles are magnetic anisotropy particles.

4. The extrusion-molded magnet according to claim 1, wherein the synthetic rubber or thermoplastic synthetic resin is a thermoplastic polyolefin system synthetic resin.

5. An extrusion-molded magnet having samarium-iron-nitrogen system magnetic particles obtained by a method comprising:

adding samarium-iron-nitrogen system magnetic particles and ferrite particles to a synthetic rubber or a thermoplastic synthetic resin to form a mixture, said samarium-iron-nitrogen system magnetic particles comprising samarium, iron and nitrogen particles, molding the mixture into a flexible material, and magnetizing the flexible material to obtain the extrusion-molded magnet.

6. The extrusion-molded magnet according to claim 5, wherein the samarium-iron-nitrogen system magnetic particles are added as magnetic anisotropy particles.

7. The extrusion-molded magnet according to claim 5, wherein the mixture is extrusion molded while being subjected to a magnetic field orientation.

8. The extrusion-molded magnet according to claim 5, wherein the samarium-iron-nitrogen system magnetic particles and ferrite particles are added as magnetic anisotropy particles.

9. The extrusion-molded magnet according to claim 5, wherein the synthetic rubber or thermoplastic synthetic resin is a thermoplastic polyolefin system synthetic resin.

10. A method of making an extrusion-molded magnet having samarium-iron-nitrogen system magnetic particles comprising:

adding samarium-iron-nitrogen system magnetic particles and ferrite particles to a synthetic rubber or a thermoplastic synthetic resin to form a mixture, said samarium-iron-nitrogen system magnetic particles comprising samarium, iron and nitrogen particles, molding the mixture into a flexible material, and magnetizing the flexible material to make the extrusion-molded magnet.

11. The method according to claim 10, wherein the samarium-iron-nitrogen system magnetic particles are added as magnetic anisotropy particles.

12. The method according to claim 10, wherein the mixture is extrusion molded while being subjected to a magnetic field orientation.

13. The method according to claim 10, wherein the samarium-iron-nitrogen system magnetic particles and ferrite particles are added as magnetic anisotropy particles.

14. The method according to claim 10, wherein the synthetic rubber or thermoplastic synthetic resin is a thermoplastic polyolefin system synthetic resin.

* * * * *